United States Patent [19]

Novajovsky

[11] Patent Number: 4,626,733

[45] Date of Patent: Dec. 2, 1986

[54] RADIATOR BAND FOR AN AIR-COOLED ELECTRON TUBE

[75] Inventor: William A. Novajovsky, Manheim Township, Lancaster County, Pa.

[73] Assignee: RCA Corporation, Princeton, N.J.

[21] Appl. No.: 654,482

[22] Filed: Sep. 26, 1984

[51] Int. Cl.[4] ..... H01J 7/24; H01J 19/36

[52] U.S. Cl. ..... 313/40; 313/45

[58] Field of Search ..... 313/40, 45, 20–22; 165/76, 80 B, 185; 315/39.51, 39.75, 39.77

[56] References Cited

U.S. PATENT DOCUMENTS

| | | | |
|---|---|---|---|
| 2,471,005 | 5/1949 | Norton | 250/27.5 |
| 2,939,988 | 6/1960 | Culbertson et al. | 313/250 |
| 2,951,172 | 8/1960 | Griffiths, Jr. et al. | 313/247 |
| 3,252,043 | 5/1966 | Doner | 313/348 |
| 4,109,179 | 8/1978 | McKinnon | 315/39.75 |
| 4,295,077 | 10/1981 | Carter et al. | 313/293 |

*Primary Examiner*—Palmer C. DeMeo
*Assistant Examiner*—Sandra L. O'Shea
*Attorney, Agent, or Firm*—Eugene M. Whitacre; Dennis H. Irlbeck; Vincent J. Coughlin, Jr.

[57] ABSTRACT

An air-cooled electron tube comprises an envelope including an anode forming a section thereof. A plurality of discrete radiator fins having a proximal end and a distal end are disposed so that the proximal end of each fin is adjacent to the anode. A radiator band having an interior surface circumscribes the radiator fins so that the interior surface of the band is adjacent to the distal end of the fins. The band includes at least one projection, and preferably two, formed around the interior surface of the band. The projection is raised about 0.38 mm above the interior surface and terminates in a sharp edge which pierces the distal ends of selected ones of the radiator fins so as to contact the distal end of each of the fins, thereby urging the proximal ends of the fins into contact with the anode.

3 Claims, 6 Drawing Figures

RADIATOR BAND FOR AN AIR-COOLED ELECTRON TUBE

BACKGROUND OF THE INVENTION

The present invention relates to an air-cooled electron tube and, primarily, to an improved radiator band having abutment means for an air-cooled power tube.

Many high power electron tubes for use in UHF and VHF operation have an anode which forms a section of the envelope of the tube. In order to improve the cooling efficiency of such a tube, a plurality of discrete radiator fins are attached, for example by brazing, to the external surface of the anode. Air is passed axially through the array of radiator fins to cool the tube. A cylindrical radiator band, or collar, surrounds the radiator fins. The radiator band serves two functions. First, it contacts the outer edge of each of the radiator fins, thereby holding the inside edge of each fin against the anode during the brazing operation to secure the fins to the anode. Second, the radiator band helps to channel the flow of air through the array of radiator fins.

In order for the first function of the radiator band to be realized, each of the radiator fins must have nearly identical radial dimensions so that the radiator band will contact the outside edge of each fin and hold it against the anode during the brazing operation. It has been found that because of the variations in radial dimensions of the radiator fins, only the fins having the greatest radial dimension are contacted by the radiator band. The fins having a lesser radial dimension are not contacted by the radiator band and, thus, are not firmly attached to the anode during brazing. Improper mechanical contact of a radiator fin to the anode deleteriously effects the heat transfer from the anode and the cooling of the tube.

SUMMARY OF THE INVENTION

An air-cooled electron tube comprises an envelope, including an anode forming a section thereof. A plurality of discrete radiator fins having a proximal end and a distal end are disposed so that the proximal ends of the fins are adjacent to the anode. A radiator band having an interior surface circumscribes the radiator fins so that the interior surface of the band is adjacent to the distal ends of the fins. The band is improved over prior art bands by including abutment means around the interior surface of the band and extending inwardly therefrom for contacting the distal end of each of the radiator fins, thereby urging the proximal ends of the fins against the anode.

DETAILED DESCRIPTION OF THE PREFERRED EMBODIMENT

Figure 1:
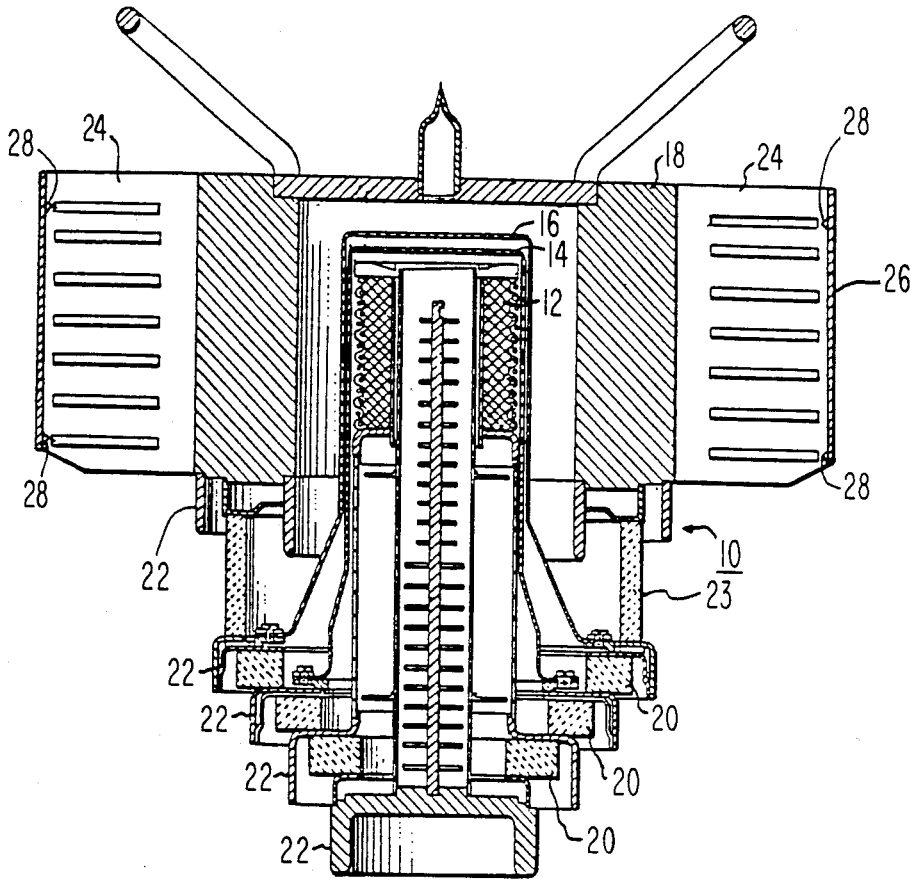
FIG. 1 is a longitudinal cross-sectional view of an air-cooled high power electron tube employing the novel radiator band.

With initial reference to FIG. 1, an air-cooled high power electron tube, generally designated 10, comprises a cathode 12, a control grid 14, a screen grid 16 and an anode 18. These tube elements are all cylindrical and are in coaxial, nested, non-abutting relationship with one another. One end of each of the coaxial elements is spaced from an adjacent element by ceramic rings 20 disposed therebetween. Electrical contact terminal areas 22 are provided for the cathode 12, the control grid 14 and the screen grid 16 and the anode 18. An anode ceramic 23 is disposed between the screen grid terminal area 22 and the anode 18.

The anode 18 is preferably made of copper because of the heat conduction properties of copper. A plurality of copper radiator fins 24 are affixed, for example by brazing, to the outside surface of the anode 18 to further increase the heat dissipation ability of the tube 10. A cylindrical radiator band 26, preferably made of cold-rolled steel, is disposed circumferentially around the radiator fins 24. The radiator band 26 includes at least one circumferential projection 28, although, two are preferred, formed around the interior surface of the band 26. The projection 28 is raised about 0.38 mm (15 mils) above the interior surface of the band 26 and terminates in a sharp edge which abuts the fins 24.

Figure 2:
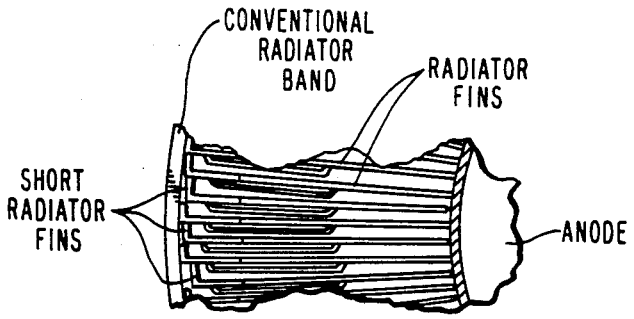
Fig. 2 PRIOR ART
FIG. 2 is a fragmentary view of a prior art tube having a conventional radiator band.

A fragment of a prior art tube, shown in FIG. 2, demonstrates the problem of brazing the radiator fins to the anode of the tube. The scale of FIG. 2 is exaggerated to more clearly show the variations in radial dimension of the radiator fins. The radiator fins are manufactured to a radial dimension tolerance of $\pm 0.076$ mm ($\pm 3$ mils). Since the difference between the largest and smallest radial dimension variation is 0.152 mm (6 mils), it is clear that a conventional radiator band having a flat interior surface cannot uniformly contact each of the radiator fins and urge all of the fins against the anode during the brazing step in which the radiator fins are affixed to the anode. As a consequence, the short fins (three are shown in FIG. 2) do not contact the anode, and the anode-radiator fin assembly must be rejected.

Figure 3:
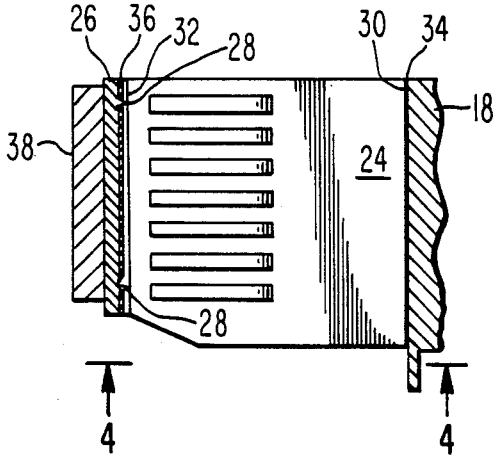
FIG. 3 is a fragmentary view of the novel radiator band during a step in the radiator fin brazing operation.
Figure 4:
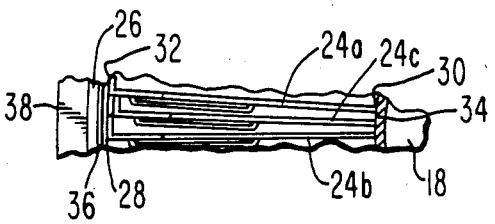
FIG. 4 is a view taken along lines 4—4 of FIG. 3.

The novel radiator band 26, shown in detail in FIGS. 3–6, provides good mechanical contact between the radiator fins 24 and the anode 18. With reference to FIGS. 3 and 4, each of the radiator fins 24 has a proximal end 30 and a distal end 32. The proximal end 30 of each fin 24 is disposed flush with a solder strip 34 that is wrapped around the anode 18. A second solder strip 36 is affixed to the interior surface of the radiator band 26, and the band 26 is disposed circumferentially around the radial array of radiator fins 24 so that the circumferential projections 28 extend inwardly from the band 26 and contact the distal end 32 of at least those radiator fins 24 having the largest radial dimension. FIG. 4 shows a fragmentary view of projection 28 in contact with two of the radiator fins **24*a* and 24*b* having large radial dimensions. A short radiator fin 24*c* is disposed between the two radiator fins 24*a* and 24*b*. A braze retainer fixture 38 of a low expansion metal, such as steel, is disposed around, and in contact with, the exterior surface of the radiator band 26**.

Figure 5:
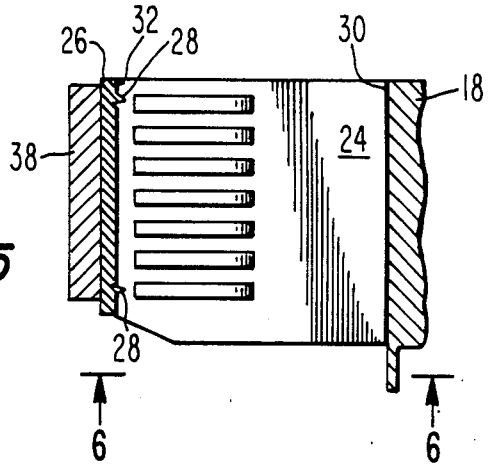
FIG. 5 is a fragmentary view of the novel radiator band during a subsequent step in the radiator fin brazing operation.
Figure 6:
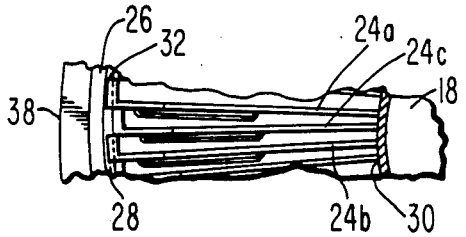
FIG. 6 is a view taken along line 6—6 of FIG. 5.

Next, the assembly comprising the anode 18, radiator fins 24, radiator band 26 and braze retainer fixture 38 is brazed at about 830° C. for about 27 minutes and slow cooled for about 80 minutes. Brazing is well known in the art and need not be described. During the brazing operation, the copper anode 18 and copper radiator fins 24 expand at a greater rate than the steel radiator band 26 and steel braze retainer fixture 38. As shown in FIGS. 5 and 6, the 0.38 mm long, relatively hard, steel projctions 28 pierce the distal end 32 of the softer copper radiator fins 24, having the largest radial dimension, and contact even the radiator fins, having the shortest radial dimension. The resulting structure, shown in FIGS. 5 and 6, assures that the proximal end 30 of each of the radiator fins 24 is urged against the anode 18 and brazed in contact therewith. Following the brazing operation, the braze retainer fixture 38 is removed from around the radiator band 26. While the radiator band 26 is preferably formed from a material that is harder than the material used to form the radiator fins 24, it should be clear to one skilled in the art that the radiator band material can be formed from the same material as that of the radiator fins, or even a softer material. In the latter case, the projections 28 would be flattened by the radiator fins 24 having the largest radial dimension, but would extend inwardly to contact the radiator fins 24 having smaller radial dimensions.

What is claimed is:

1. In an air-cooled electron tube comprising an envelope including an anode forming a section of said envelope, a plurality of discrete radiator fins each having a proximal end and a distal end, said radiator fins having said proximal ends disposed adjacent to said anode and said distal ends circumscribed by a radiator band having an interior surface adjacent to said distal ends, the improvement wherein said radiator band includes abutment means provided around said interior surface and extending inwardly therefrom for contacting said distal ends of said radiator fins, wherein said abutment means includes at least one circumferential projection which terminates in a sharp edge which pierces said distal ends of selected ones of said radiator fins, thereby contacting each of said radiator fins to urge said proximal ends thereof against said anode.

2. The electron tube as in claim 1, wherein said radiator band is formed from a material having a hardness greater than the material of said radiator fins.

3. In an air-cooled power tube comprising an evacuated envelope including an anode forming a section of said envelope, a plurality of discrete radiator fins radially disposed around said anode, each of said radiator fins having a proximal end and a distal end, said proximal ends being adjacent to said anode and said distal ends being circumscribed by a radiator band having an interior surface, the improvement wherein said radiator band having at least one circumferential projection formed around the interior surface thereof, said projection terminating in a sharp edge which pierces said distal ends of selected ones of said radiator fins thereby contacting each of said radiator fins and urging said proximal ends into contact with said anode.

* * * * *